United States Patent [19]

Smith

[11] 3,976,296

[45] Aug. 24, 1976

[54] MAGNETIC GAME APPARATUS

[76] Inventor: Robert A. Smith, c/o Henry R. Smith, 3617 Mary Ave., Baltimore, Md. 21206

[22] Filed: Dec. 2, 1974

[21] Appl. No.: 528,724

[52] U.S. Cl. ..... 273/85 A; 46/240; 273/1 M; 273/85 D; 273/85 F

[51] Int. Cl.[2] ..... A63F 7/06

[58] Field of Search ..... 273/85, 1 M, 118 A, 273/119 A, 126 A, 138 A, 120 A, 122 A, 123 A, 94 R; 46/239, 240, 236, 238

[56] References Cited

UNITED STATES PATENTS

| | | | |
|---|---|---|---|
| 962,069 | 6/1910 | Walters et al. | 46/240 X |
| 1,167,020 | 1/1916 | Reuter | 273/1 M |
| 2,282,430 | 5/1942 | Smith | 46/240 X |
| 2,770,073 | 11/1956 | Sullivan | 46/239 X |
| 2,795,427 | 6/1957 | Sachs | 46/238 X |
| 2,903,264 | 9/1959 | Munro et al. | 273/85 A |
| 3,672,674 | 6/1972 | Reed | 273/94 R |

FOREIGN PATENTS OR APPLICATIONS

| | | | |
|---|---|---|---|
| 1,009,590 | 3/1952 | France | 273/85 R |
| 1,118,123 | 3/1956 | France | 273/85 F |
| 514,333 | 2/1955 | Italy | 273/85 D |
| 309,217 | 11/1955 | Switzerland | 273/85 R |

*Primary Examiner*—Richard C. Pinkham
*Assistant Examiner*—Harry G. Strappello
*Attorney, Agent, or Firm*—William C. Norvell, Jr.

[57] ABSTRACT

A game apparatus comprising a playing surface with a plurality of playing members on the surface. A ball member is adapted to move over the playing surface among the playing members with a magnetic element within the ball member. A rotatable surface located below the playing surface carries a plurality of second magnetic elements which exert magnetic forces on the magnetic element within the ball. The movement of the rotatable surface randomly positions the ball member on the playing surface and among the playing members.

2 Claims, 3 Drawing Figures

Fig: 1.
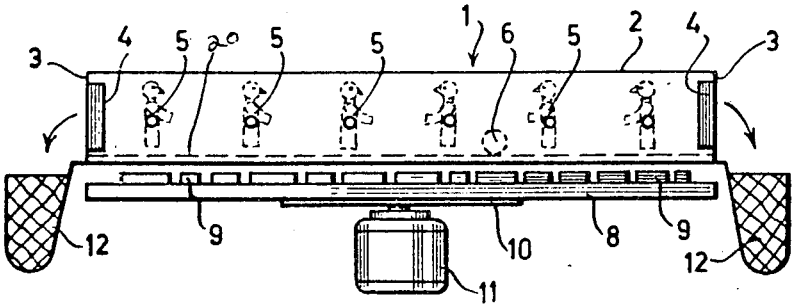
Fig: 2.
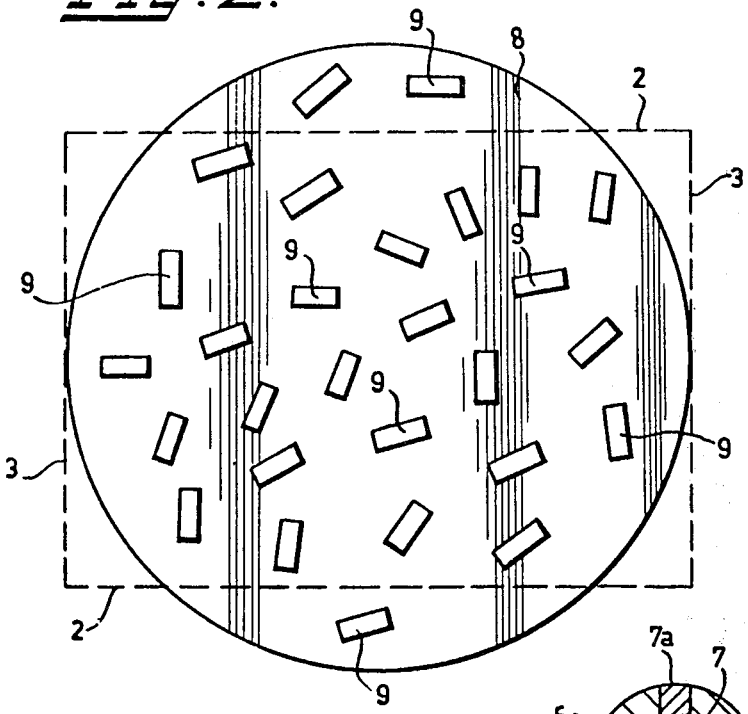
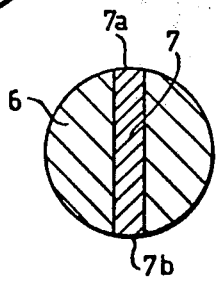
Fig: 3.

MAGNETIC GAME APPARATUS

BACKGROUND OF THE INVENTION

1. Field of the Invention

The invention generally relates to a device for use in a game apparatus, the device providing random placement of a ball member.

2. Description of the Prior Art

Numerous games, such as football and hockey are known to the public whereby a base has active elements (representing the participants) affixed thereto. Sometimes, one or more goals are indicated or provided and communicate with the base, for receipt of an object, such as a ball or a puck. Most of these games have hand activated members which either move the object to the active element or move the active element to the object such that the object is urged to the goal area. Although quite popular, these games oftentimes are unrealistic in that the active elements often "jerk" or move only in one direction to contact the object or, in other variations of this basic game, the object is moved to the active element in very predictable and repitious patterns.

It is an object, therefore, of the present invention to provide a game system wherein the object may be randomly moved over an area of play.

It is a further object of the present invention to provide a game system wherein the object may be randomly moved over an area of play by means other than by contact with the active or participant elements.

Other objects and improvements will be apparent from a reading of the specification, the Figs. and the claims which follow.

SUMMARY OF THE INVENTION

The invention incorporates a game apparatus for playing football, hockey, socker, and the like, comprising a housing having a plurality of longitudinal side members interconnected to a plurality of transverse side members, a playing surface communicating with the said side members, a plurality of participating elements on said playing surface, a ball member having therein at least one magnetic element, at least one rotatable disc member below the playing surface, said disc member carrying a plurality of magnetic members for complimentary activation of the ball member upon rotation of the disc member.

BRIEF DESCRIPTION OF THE DRAWINGS

FIG. 1 is a horizontal sectional drawing through the preferred game apparatus.

FIG. 2 is a lower planar view of the apparatus as shown in FIG. 1.

FIG. 3 is a vertical sectional drawing of the preferred ball object shown on the playing surface in FIG. 1.

DESCRIPTION OF THE PREFERRED EMBODIMENTS

Referring to FIG. 1, the game device 1 has upright enclosing walls 2 and 3 for containment of the game participants and the game activity. Walls 2 are horizontal while interconnecting walls 3 are transverse. Transverse walls 3 each are provided with an opening 4 for receipt of the playing element or ball 6 and for subsequent disposal thereof within a receiving net 12. The ball 6 and participants 5 contact the playing field 20 which is contained within the walls 2 and 3.

Under the playing field 20 is a selectively movable member 8, preferably of a plate or disc configuration. The member 8 has permanently affixed to the upwardly facing surface thereof a series of magnets 9. The member 8 is attached to a drive element 10 which, in turn, is driven by means such as an electric motor 11 of any conventional and known type. Preferably, the member 8 should have a diameter at least equal to or in excess of the length and width of the walls 2 and 3, respectively, as is shown in FIG. 2. The member 8 is in communication with the playing field 20, such that the magnets 9 affixed thereto will influence a cooperatively similar magnet 7 within the ball 6, whereby the ball 6 is exposed to the action of a particular force by attraction or repulsion.

The ball 6, which may be of plastic, wood, rubber, or the like is provided with a magnet, such as 7, which is cylindrical, as shown in FIG. 3. The uppermost end *7a* of the magnet 7 is a north magnetic pole, while the lowermost end *7b* of the magnet 7 is a south magnetic pole. It is this polarization which works in combination with the magnets carried on the rotatable member which effects the unique operation of the present invention.

Upon activation of the motor 11, the ball 6 will move in an arbitrary and generally unpredictable pattern as the result of the magnet 7 therein being influenced by the magnets 9, which are moved as the result of the rotation of the motor 11 driving the drive element 10 affixed to the lowerly facing surface of the member 8. Accordingly, the axis of the magnet 7 in the ball 6 will thereby change its direction continuously. As the member 8 is moved, the ball 6 will roll and turn on its own axis and may collide with the fixed and stable participants 5. At a particular moment, the ball 6 may land, however, in opening 4 in the transverse wall 3, which serves as a goal and from the goal, in the net or receptacle 12, the ball 6 can again be brought on the field through an opening. It is also possible to make an additional provision for returning the ball 6 directly to the playing surface 20 by causing the ball to pass to the center of the playing field 20.

Although the invention has been described in detail, alternative embodiments will be readily apparent. Accordingly, modifications can be made without departing from the spirit or scope of the claims hereto. For example, instead of a rotated disc member 8, an endless belt may be utilized on which the magnets 9 are affixed. Alternatively, a plurality of discs 8 may be arranged under the playing surface 20. Additionally, magnets which are secured at a fixed location may be used and arbitrarily and selectively activated, such as by energizing same by means of incremental electrical current charges. Rotatable rods or rollers provided with magnets or electromagnets also may be used instead of the magnets represented in the Figs.

The present apparatus can be applied to a number of game systems, such as football, rugby football, hockey, and the like.

What is desired to be secured by Letters Patent is:

1. A game apparatus comprising a playing surface, a plurality of playing members located on said playing surface, a ball member adapted to move over said playing surface and among said playing members, at least one first magnetic element located within said ball member, a rotatable surface located adjacent to and below the playing surface, said rotatable surface carrying a plurality of second magnetic elements, said second magnetic elements being capable of exerting magnetic forces upon the first magnetic element within the ball, whereby movement of said rotatable surface beneath said playing surface provides means for randomly positioning said ball member on the playing surface.

2. The apparatus of claim 1 wherein the rotatable surface comprises at least one disc.

* * * * *